US008642186B2

(12) United States Patent
Hama et al.

(10) Patent No.: US 8,642,186 B2
(45) Date of Patent: Feb. 4, 2014

(54) DECORATIVE PLATE AND METHOD FOR MANUFACTURE THEREOF

(75) Inventors: Kazuhiro Hama, Tokyo (JP); Hirotoshi Suetugu, Saitama (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 1331 days.

(21) Appl. No.: 12/063,591

(22) PCT Filed: Aug. 11, 2006

(86) PCT No.: PCT/JP2006/315962

§ 371 (c)(1),
(2), (4) Date: Feb. 12, 2009

(87) PCT Pub. No.: WO2007/020900

PCT Pub. Date: Feb. 22, 2007

(65) Prior Publication Data

US 2009/0247038 A1 Oct. 1, 2009

(30) Foreign Application Priority Data

Aug. 12, 2005 (JP) ..... 2005-234547

(51) Int. Cl.
*A47G 35/00* (2006.01)

(52) U.S. Cl.
USPC ..... 428/542.6; 428/913.3

(58) Field of Classification Search
USPC ..... 428/913.3, 542.6
See application file for complete search history.

(56) References Cited

U.S. PATENT DOCUMENTS

| | | | | |
|---|---|---|---|---|
| 4,196,033 | A * | 4/1980 | Arai et al. | 156/196 |
| 4,243,462 | A * | 1/1981 | Hori et al. | 156/310 |
| 6,852,399 | B2 * | 2/2005 | Takahashi et al. | 428/213 |

FOREIGN PATENT DOCUMENTS

| | | |
|---|---|---|
| JP | 09-011265 | 1/1997 |
| JP | 09-011285 | 1/1997 |
| JP | 09-011407 | 1/1997 |
| JP | 10-006446 | 1/1998 |
| JP | 11-020064 | 1/1999 |
| JP | 11-173013 | 6/1999 |
| JP | 11-207877 | 8/1999 |
| JP | 2001-018331 | 1/2001 |
| JP | 2001-303476 | 10/2001 |
| JP | 2004-299284 | 10/2004 |

OTHER PUBLICATIONS

Japanese Official Action dated Oct. 18, 2011, for JP Application No. 2007-530984.

* cited by examiner

*Primary Examiner* — Lynda Salvatore
(74) *Attorney, Agent, or Firm* — Antonelli, Terry, Stout & Kraus, LLP.

(57) ABSTRACT

Provided is a thermosetting resin decorative plate comprising a decorative sheet comprising a base material and a picture layer formed thereon, wherein the base material is a non-woven fabric comprising chemical fibers or a mixed paper of chemical fibers and pulps, and the above decorative plate makes it possible to work a three-dimensional form.

11 Claims, 1 Drawing Sheet

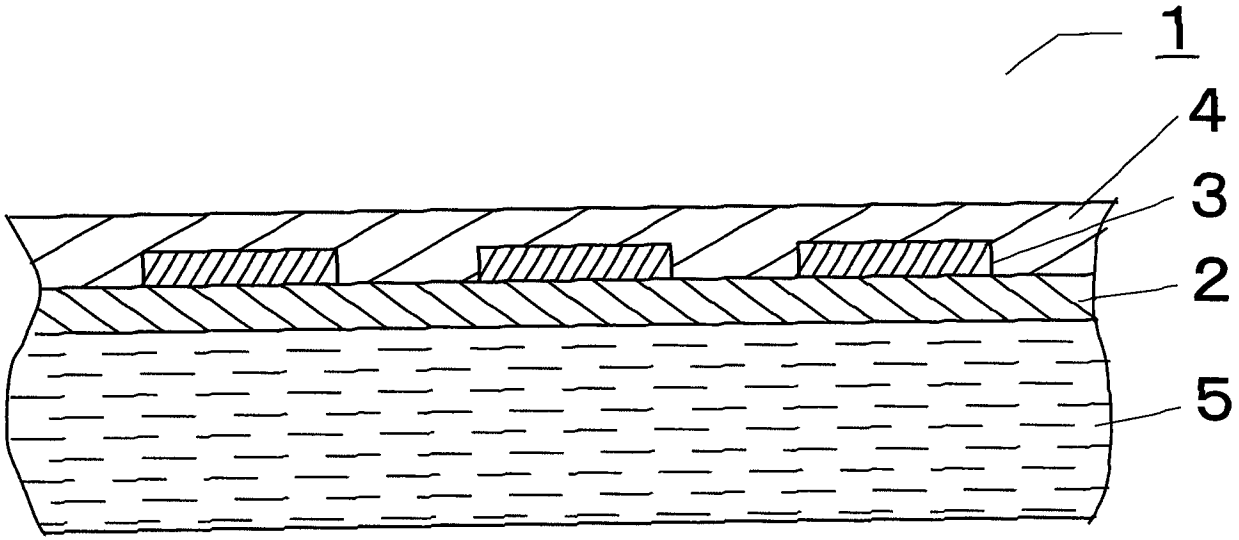
1
4
3
2
5

DECORATIVE PLATE AND METHOD FOR MANUFACTURE THEREOF

BACKGROUND OF THE INVENTION

The present invention relates to a decorative plate for building materials provided with surface design which is used for furnitures, business desks for offices, wall surfaces, floor materials and the like, more specifically to a decorative plate suited to molding two-dimensional, particularly three-dimensional forms.

RELATED ART

A thermosetting resin decorative plate has excellent characteristics in an impact resistance, a contamination resistance, a pencil hardness and the like and includes, to be specific, high pressure melamine resin decorative plates, low pressure melamine resin decorative plates, diallyl phthalate (DAP) resin decorative plates, polyester decorative plates, guanamine resin decorative plates, phenol resin decorative plates and the like. Among them, particularly the melamine resin decorative plates have a hard surface and are excellent in a heat resistance and a contamination resistance, and a wide range of colored patterns can be selected in a design property. Accordingly, they are widely used for table tops, sinks, top boards of desks and the like.

Melamine resin decorative plates and the like are subjected in a certain case to bending work in a two-dimension such as postform work, and a postform aptitude is controlled in a cured state of the melamine resin and the like. Further, use of a modified-melamine resin obtained by adding a plasticizer to a melamine resin and a decorative plate which is a thick matter obtained by laminating a core-impregnated paper and a thermoplastic film one after the other and which is excellent in postform work are proposed in order to make bending work easier (refer to, for example, a patent document 1).

However, while the above thermosetting resin decorative plates can be subjected to bending work in a two-dimension, a base paper (titan paper and the like) for melamine and a phenol core paper (phenol resin-impregnated kraft paper and the like) which are used for the above decorative plates are not stretchable, and therefore it is impossible to work a three-dimensional form. Accordingly, there have been the problems that cracks are caused in working and that the surface layer is peeled off Patent document 1: Japanese Patent Application Laid-Open No. 11407/1997

DISCLOSURE OF THE INVENTION

In light of the problems described above, an object of the present invention is to provide a thermosetting resin decorative plate comprising a melamine resin and the like which makes it possible to work a three-dimensional form.

Intensive researches repeated by the present inventors in order to achieve the object described above have resulted in finding that a thermosetting resin decorative plate comprising a melamine resin or the like which makes it possible to work a three-dimensional form is obtained by using a nonwoven fabric as a base material for a decorative sheet constituting the thermosetting resin decorative plate. The present invention has been completed based the above knowledge.

That is, the present invention provides:

(1) a thermosetting resin decorative plate comprising a decorative sheet comprising a base material and a picture layer formed thereon, wherein the base material is a nonwoven fabric comprising chemical fibers or a mixed paper of chemical fibers and pulps, (2) the decorative plate as described in the above item (1), prepared by impregnating the decorative sheet with a thermosetting resin or laminating an overlay paper impregnated with a thermosetting resin on the decorative sheet and subjecting it to press molding or hot press molding, (3) the decorative plate as described in the above item (1) or (2), prepared by laminating a fibrous base material or woody base material impregnated with a thermosetting resin on a rear face of the decorative sheet and subjecting it to press molding or hot press molding, (4) the decorative plate as described in any of the above items (1) to (3), wherein a content of the pulp contained in the mixed paper constituting the decorative sheet is 60 mass % or less based on the mixed paper, (5) the decorative plate as described in any of the above items (1) to (4), wherein a size of the chemical fibers constituting the nonwoven fabric is 0.5 to 3.0 denier, (6) the decorative plate as described in any of the above items (1) to (5), wherein a basis weight of the base material constituting the decorative sheet is 40 to 150 g/m$^2$, (7) the decorative plate as described in any of the above items (1) to (6), wherein an air permeability of the base material is 10 seconds or less, (8) the decorative plate as described in any of the above items (1) to (7), wherein it shows an elongation rate of 10% or more in any direction under heating at 120° C., (9) the decorative plate as described in any of the above items (1) to (8), wherein the thermosetting resin is a melamine resin,

(10) a decorative sheet used for the decorative plate as described in any of the above items (1) to (9),

(11) a production process for a decorative plate, comprising impregnating a decorative sheet comprising a base material and a picture layer formed thereon with a thermosetting resin or laminating an overlay paper impregnated with a thermosetting resin on the decorative sheet, laminating a fibrous base material or woody base material impregnated with a thermosetting resin on a rear face of the decorative sheet to form a laminate and subjecting it to press molding or hot press molding to cure the thermosetting resin and integrate the laminate, wherein the base material constituting the decorative sheet is a nonwoven fabric comprising chemical fibers or a mixed paper of chemical fibers and pulps,

(12) the production process for a decorative plate as described in the above item (11), wherein a content of the pulp contained in the mixed paper constituting the decorative sheet is 60 mass % or less based on the mixed paper,

(13) the production process for a decorative plate as described in the above item (11) or (12), wherein a size of the chemical fibers constituting the nonwoven fabric is 0.5 to 3.0 denier,

(14) the production process for a decorative plate as described in any of the above items (11) to (13), wherein a basis weight of the base material constituting the decorative sheet is 40 to 150 g/m$^2$,

(15) the production process for a decorative plate as described in any of the above items (11) to (14), wherein an air permeability of the base material is 10 seconds or less and

(16) the production process for a decorative plate as described in any of the above items (11) to (15), wherein the decorative plate shows an elongation rate of 10% or more in any direction under heating at 120° C.

According to the present invention, a thermosetting resin decorative plate comprising a melamine resin and the like which makes it possible to work a three-dimensional form can be provided.

BRIEF DESCRIPTION OF THE DRAWING

FIG. 1 is a schematic drawing showing a cross section of the decorative plate of the present invention.

EXPLANATION OF THE CODES

1. Decorative plate
2. Base material
3. Picture layer
4. Thermosetting resin
5. Fibrous base material or woody base material impregnated with a thermosetting resin

BEST MODE FOR CARRYING OUT THE INVENTION

The structure of the decorative plate of the present invention shall be explained with reference to FIG. 1. The decorative plate of the present invention is a thermosetting resin decorative plate comprising a decorative sheet comprising a base material 2 and a picture layer 3 provided thereon by an ink for a building material which is used for conventional thermosetting resins. The above decorative sheet is impregnated with a thermosetting resin 4 and laminated on a rear face thereof, if necessary, with a fibrous base material or woody base material 5 impregnated with a thermosetting resin, and it is heated and molded by pressing, whereby a thermosetting resin decorative plate 1 is obtained.

The base material 2 used for the decorative sheet of the present invention is characterized by that it is a nonwoven fabric comprising chemical fibers or a nonwoven fabric comprising a mixed paper of chemical fibers and pulps.

The chemical fibers include organic fibers of polyester resins such as polyethylene terephthalate, polybutylene terephthalate and the like; polyamide resins such as nylon 6, nylon 66 and the like; acryl resins; polyolefin resins such as polyethylene, polypropylene and the like; rayon, acetate, polyvinyl chloride, vinylon and the like, and among them, the polyester resins are most preferred considering physical properties such as an adhesive property, a processability, a strength, a cost and the like. Use of the chemical fibers for the base material 2 makes it possible to three-dimensionally work the decorative plate of the present invention, and it makes it possible as well to control pH of the above base material and inhibit influence exerted to curing of the thermosetting resin such as a melamine resin and the like which shall be described later in details.

Three-dimensional working referred to in the above explanation means bending the decorative plate in a curved form by pressing or heating and pressing and working it sterically, and it means that the decorative plate is not extended only in one direction. On the other hand, two-dimensional working means bending the decorative plate in one direction by pressing or heating and pressing, and it means that the decorative plate is extended only in one limited direction.

The mixed paper of chemical fibers and pulps described above is suitably used as well for the nonwoven fabric in the present invention. In this case, a content of the pulp is preferably 60 mass % or less based on the mixed paper. If a content of the pulp is 60 mass % or less, a sufficient elongation rate of the base material can be secured.

In the decorative sheet of the present invention, a size of the chemical fibers constituting the nonwoven fabric which is the base material falls preferably in a range of 0.5 to 3.0 denier. If a size of the chemical fibers is 0.5 denier or more, they are not cut in the production step of the decorative plate. On the other hand, if a size of the chemical fibers is 3.0 denier or less, strike-through is not caused in printing, and the design property is enhanced.

A basis weight of the base material falls preferably in a range of 40 to 150 g/m$^2$. If a basis weight of the base material is 40 g/m$^2$ or more, a problem of strike-through in printing is not brought about. On the other hand, if a basis weight of the base material is 150 g/m$^2$ or less, a satisfactory impregnating property of the thermosetting resin is obtained.

Further, an air permeability of the base material is preferably controlled to 10 seconds or less. If an air permeability of the base material is 10 seconds or less, it is preferred in terms of obtaining an adhesive property of the decorative sheet onto an adherent, a smoothness of the decorative plate and an impregnating property of the thermosetting resin.

In a value of the air permeability in the present invention, time required for 300 mL of air to permeate a circular part (78.5 mm$^2$) having a diameter of 10 mm in a test piece is shown by the number of seconds based on JIS P8117. Accordingly, when the measuring conditions are explicitly shown, an air permeability of 4 seconds is an air permeability of 4 [second/(300 mL·78.5 mm$^2$)].

In particular, the base material satisfying all the conditions of a size of the chemical fibers described above and a basis weight and an air permeability of the base material is preferred in terms of securing impregnation of the thermosetting resin and bringing about no such problem as a short interlayer strength due to shortage of the resin amount.

The picture layer 3 shown in FIG. 1 provides the decorative plate 1 with a decorative property and is formed by printing various patterns using an ink and a printing machine. The patterns include woodgrain patterns, stone-grain patterns imitating surfaces of rocks such as marble patterns (for example, travertine marble patterns), textile patterns imitating blanket texture patterns and cloth-like patterns, tiling patterns, brick work patterns and the like and include as well parquetry patterns and patchwork patterns which are obtained by combining the above patterns.

Any of conventional rotary printing such as gravure printing, flexographic printing and silk screen printing and sheet-feed printing can be applied as the printing method. The preferred printing method is gravure rotary printing in which a selection width of binders of inks is broad and which is less liable to exert an influence to the impregnation step of the thermosetting resin.

The ink used for printing the picture layer 3 in the present invention shall not specifically be restricted as long as it is an ink for building materials which is suited for molding conventional thermosetting resins. To be specific, it includes cellulose derivatives such as ethyl cellulose, nitrocellulose, ethyl hydroxyethyl cellulose, cellulose acetate propionate, cellulose acetate, cellulose butyrate and the like, styrene base resins such as polystyrene, poly-α-methylstyrene and the like, (meth)acryl base resins such as polyethyl(meth)acrylate, polybutyl (meth)acrylate and the like, rosin, rosin ester resins such as rosin-modified maleic acid resins, rosin-modified phenol resins, polymerized rosin and the like, polyvinyl acetate resins, coumarone resins, vinyltoluene resins, vinyl chloride resins, polyester resins, polyurethane resins, butyral resins, polyamide resins, vinyl chloride-vinyl acetate copolymer resins, natural resins such as shellac, gum arabic, alkaloid, mastic and the like. Among them, the cellulose derivatives are preferred since they show a good affinity in impregnating and molding.

When a pulp content of the nonwoven fabric is small, the cellulose derivatives soluble in solvents which enhance an adhesive property of the picture ink onto the nonwoven fabric are preferred. When an aqueous ink is used, capable of being used are water-soluble resins such as casein base resins, hydroxypropyl cellulose, polyacrylic acid ester copolymers, polymethacrylic acid esters, urea base resins, melamine base resins and the like.

The colorant is preferably inorganic or organic pigments which are not discolored in hot pressing work and which have an excellent durability. To be specific, it includes inorganic pigments such as chrome yellow, cadmium yellow, yellow iron oxide, titanium oxide, Prussian blue, carbon black, red iron oxide and the like and organic pigments such as diazo base pigments, isoindolinone, polyazo pigments, quinacridone, phthalocyanine blue and the like. Further, it includes pigments having pearl-like gloss, such as aluminum powder, copper powder, fine cut pieces of metal-deposited synthetic resin films, titanium oxide-coated mica, argentine and the like.

Further, in order to enhance an interlayer adhesive strength of the ink coating film and raise an impregnating property of the thermosetting resin into the ink, extender pigments such as silica, barium sulfate, kaoline, talc, calcium carbonate and the like can be added.

The decorative plate 1 of the present invention is prepared by impregnating the decorative sheet with the thermosetting resin or laminating an overlay paper impregnated with the thermosetting resin on the decorative sheet. It does not specifically matter what kind of the thermosetting resin is used in the above case as long as it can be used for a decorative plate, and it includes, for example, melamine resins, diallyl phthalate resins, guanamine resins, polyester resins, phenol resins and the like. The melamine resins are preferred in terms of a surface hardness after thermally cured.

The decorative sheet and the overlay paper are impregnated with the solutions of the resins described above and dried by a conventional method using a thermosetting resin impregnating machine.

The decorative sheet may be impregnated with the thermosetting resin from a print surface thereof, and the overlay paper impregnated with the thermosetting resin may further be laminated thereon.

In the decorative plate 1 of the present invention, the fibrous base material or woody base material 5 impregnated with the thermosetting resin is laminated, if necessary, on a rear face (a face on which the picture layer 3 is not provided) of the decorative sheet. The fibrous base material used above shall not specifically be restricted and includes, for example, a craft paper, the nonwoven fabric described above and the like. They can be used alone or in the form of a laminate of a plurality thereof. Among the above fibrous base materials, the nonwoven fabric is more preferably used considering three-dimensional working. The above fibrous base material (hereinafter referred to as the "core paper") is impregnated with the thermosetting resin and then integrated with the base material sheet. The same resins as described above can be used as the thermosetting resin used in the above case.

The woody base material includes sliced veneers, veneers, plywoods, particle boards and medium density fiber (MDF) boards which are made of various materials such as Japanese cedar, Japanese cypress, zelkova serrata, pine, lauan, teak, Melapi and the like. These materials can be used alone or in the form of a laminate. The woody base boards involve not only woody boards but also plastic boards filled with paper powder and reinforced papers having a strength.

Among the above woody base materials, the particle boards and the medium density fiber (MDF) boards are more preferred considering a cost, a strength, a workability, a cutting property and the like.

Further, an overlay paper can be provided as well on a rear face of the fibrous base material or woody base material 5 impregnated with the thermosetting resin. The above overlay paper is effective for preventing the decorative plate from curling.

The decorative plate 1 of the present invention is produced by impregnating the surface of the decorative sheet comprising the base material 2 and the picture layer 3 with the thermosetting resin or laminating the overlay paper impregnated with the thermosetting resin on the surface of the decorative sheet, laminating the fibrous base material or woody base material 5 impregnated, if necessary, with the thermosetting resin on a rear face of the decorative sheet and subjecting it to press molding or hot press molding. The conditions of pressure, temperature and time in pressing or hot pressing can suitably be selected according to the kind of the thermosetting resin selected and the core paper, the overlay paper and the base material which are used at the same time. Usually, the pressure is selected in a range of 49 to 98 kPa (0.5 to 1.0 $kg/cm^2$), and the temperature is selected in a range of 110 to 160° C. The time is about 10 to 60 minutes.

The decorative plate produced in the manner described above shows an elongation rate of preferably 10% or more, more preferably 25% or more in any direction under heating at 120° C. The elongation rate showing 10% or more makes it possible to carry out three-dimensional working.

The decorative plate of the present invention can be subjected to decoration to a three-dimensional form by hot press molding based on the woody base material having a three-dimensional form. The decorative plate of the present invention can be used for various applications, for example, furniture, business desks for offices, cabinets for light electrical and OA appliances and the like, interior or exterior materials for buildings such as walls, ceilings, floors and the like, surface decorative plates for fittings such as window frames, doors, balustrades, baseboards, verandahs, malls and the like and interior and exterior materials for vehicles.

EXAMPLES

Next, the present invention shall be explained in further details with reference to examples, but the present invention shall by no means be restricted by these examples.

Evaluation Method:

Elongation rate: the decorative sheets and the thermosetting resin decorative plates obtained in the respective examples and comparative examples were used to measure elongation rates by means of a tensilon ("RTC-1250A", manufactured by Orientec Co., Ltd.). They were measured in a printing direction (MD: machine direction) and a direction (CD: cross direction) vertical to MD. The measuring conditions were 120° C. and 500 mm/minute.

Example 1

A nonwoven fabric manufactured by Awa Paper Mfg. Co., Ltd. prepared by using polyester fibers having a basis weight of 95 g was used as a base material, and a picture was printed thereon with a solvent base ink ("MPF-A", cellulose acetate base resin, manufactured by The Inktec Co., Ltd.) to obtain a decorative sheet. The above decorative sheet was impregnated with a melamine resin ("Cymel", manufactured by Mitsui Cyanamide Co., Ltd.), and a craft paper impregnated with a phenol resin was laminated on a rear face (a side in which the picture layer was not provided) thereof. The laminate was subjected to hot press molding and cooled down to room temperature as it was to obtain a thermosetting resin decorative plate. The above laminate was integrated on the above hot pressing condition, but the melamine resin was not completely cured. The above decorative plate was subjected to membrane press (three-dimensional working) to find that three-dimensional working could be made and that formation of cracks and peeling of the surface layer were not observed in working. Further, an elongation rate of the thermosetting resin decorative plate was measured by the method described above. The result thereof is shown in Table 1.

Example 2

A thermosetting resin decorative plate was obtained in the same manner as in Example 1, except that a nonwoven fabric manufactured by Japan Vilene Company Ltd. prepared by using polyester fibers having a basis weight of 100 g was used as the base material. Three-dimensional working could be made as was the case with Example 1, and formation of cracks and peeling of the surface layer were not observed in working. Further, the elongation rate thereof was measured as was the case with Example 1 by the method described above. The result thereof is shown in Table 1.

Example 3

A thermosetting resin decorative plate was obtained in the same manner as in Example 1, except that a mixed paper (basis weight: 100 g, manufactured by Miki Tokushu Paper Mfg. Co., Ltd.) (pulp:polyester fibers (mass ratio)=50:50) was used as the base material. Three-dimensional working could be made as was the case with Example 1, and formation of cracks and peeling of the surface layer were not observed in working. Further, an elongation rate of the thermosetting resin decorative plate obtained was measured as was the case with Example 1 by the method described above. The result thereof is shown in Table 1.

Comparative Example 1

A thermosetting resin decorative plate was obtained in the same manner as in Example 1, except that a titan paper (basis weight: 55 g, manufactured by KOHJIN Co., Ltd.) was used as the base material. The same three-dimensional working as in Example 1 was carried out to result in finding that the sufficiently necessary elongation rate was not obtained and that the base material was broken. Further, the elongation rates of the base material sheet and the thermosetting resin decorative plate obtained above were measured by the method described above. The results thereof are shown in Table 1.

Comparative Example 2

A thermosetting resin decorative plate was obtained in the same manner as in Example 1, except that an impregnated paper GF (basis weight: 60 g, manufactured by KOHJIN Co., Ltd.) was used as the base material. The same three-dimensional working as in Example 1 was carried out to result in finding that the sufficiently necessary elongation rate was not obtained and that the base material was broken. Further, the elongation rates of the base material sheet and the thermosetting resin decorative plate obtained above were measured by the method described above. The results thereof are shown in Table 1.

Comparative Example 3

A thermosetting resin decorative plate was obtained in the same manner as in Example 1, except that an impregnated paper SF (basis weight: 80 g, manufactured by KOHJIN Co., Ltd.) was used as the base material. The same three-dimensional working as in Example 1 was carried out to result in finding that the sufficiently necessary elongation rate was not obtained and that the base material was broken. Further, the elongation rates of the base material sheet and the thermosetting resin decorative plate obtained above were measured by the method described above. The results thereof are shown in Table 1.

| | | Base material sheet (%) | | | | Decorative plate (%) | |
|---|---|---|---|---|---|---|---|
| | Base material | Elongation rate (MD direction) | Elongation rate (CD direction) | Size of chemical fiber (denier) | Air permeability (second) | Elongation rate (MD direction) | Elongation rate (CD direction) |
| Example 1 | Nonwoven fabric | — | — | 2 | 2 or less | 23.8 | 26.0 |
| Example 2 | Nonwoven fabric | — | — | 2 | 1 or less | 17.7 | 20.2 |
| Example 3 | Mixed paper | — | — | 2 | 1 or less | 10.2 | 14.7 |
| Comparative Example 1 | Titan paper | 2.3 | 4.5 | — | 15 to 35 | 1.5 | 1.6 |
| Comparative Example 2 | Impregnated paper GF | 3.1 | 10.5 | — | 300 or more | 2.6 | 5.3 |
| Comparative Example 3 | Impregnated paper SF | 4.4 | 13.5 | — | 300 or more | 2.4 | 4.5 |

INDUSTRIAL APPLICABILITY

According to the present invention, capable of being provided is a thermosetting resin decorative plate comprising a melamine resin and the like which makes it possible to work a three-dimensional form, and it is most suited as a decorative plate for building materials provided with surface design which is used for furniture, business desks for offices and the like.

What is claimed is:

1. A thermosetting resin decorative plate comprising a decorative sheet comprising a base material and a picture layer formed thereon, wherein an ink used in forming the picture layer includes a cellulose derivative, wherein the base material is a nonwoven fabric comprising chemical fibers or a mixed paper of chemical fibers and pulps, wherein a size of the chemical fibers constituting the nonwoven fabric is 0.5 to 3.0 denier, the decorative plate having been prepared by impregnating the decorative sheet with a thermosetting resin or laminating an overlay paper impregnated with a thermosetting resin on the decorative sheet and subjecting it to press molding or hot press molding, and wherein the picture layer is covered with a thermosetting resin.

2. The decorative plate as described in claim 1, prepared by laminating a fibrous base material or woody base material impregnated with a thermosetting resin on a rear face of the decorative sheet and subjecting it to press molding or hot press molding.

3. The decorative plate as described in claim 1, wherein a content of the pulp contained in the mixed paper constituting the decorative sheet is 60 mass % or less based on the mixed paper.

4. The decorative plate as described in claim 1, wherein a basis weight of the base material constituting the decorative sheet is 40 to 150 $g/m^2$.

5. The decorative plate as described in claim 1, wherein an air permeability of the base material is 10 seconds or less.

6. The decorative plate as described in claim 1, wherein it shows an elongation rate of 10% or more in any direction under heating at 120° C.

7. The decorative plate as described in claim 1, wherein the thermosetting resin is a melamine resin.

8. A decorative sheet used for the decorative plate as described in claim 1.

9. The decorative plate as described in claim 1, wherein said cellulose derivative is selected from the group consisting of ethyl cellulose, nitrocellulose, ethyl hydroxyethyl cellulose, cellulose acetate propionate, cellulose acetate, and cellulose butyrate.

10. The decorative plate as described in claim 1, wherein the thermosetting resin covering the picture layer fully covers the picture layer, and is the same thermosetting resin impregnating the decorative sheet or impregnating the overlay paper laminated on the decorative sheet.

11. The decorative plate as described in claim 1, which has a three-dimensional form.

* * * * *

UNITED STATES PATENT AND TRADEMARK OFFICE

CERTIFICATE OF CORRECTION

PATENT NO. : 8,642,186 B2
APPLICATION NO. : 12/063591
DATED : February 4, 2014
INVENTOR(S) : Hama et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1698 days.

Signed and Sealed this
Twenty-ninth Day of September, 2015

Michelle K. Lee

Michelle K. Lee
*Director of the United States Patent and Trademark Office*